US008583000B2

(12) United States Patent
Nishikawa

(10) Patent No.: US 8,583,000 B2
(45) Date of Patent: Nov. 12, 2013

(54) MULTI-PATH EXHAUST APPARATUS AND IMAGE FORMING APPARATUS

(75) Inventor: Satoru Nishikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 588 days.

(21) Appl. No.: 12/786,923

(22) Filed: May 25, 2010

(65) Prior Publication Data

US 2011/0110678 A1 May 12, 2011

(30) Foreign Application Priority Data

Nov. 12, 2009 (JP) ..... 2009-259277

(51) Int. Cl.
*G03G 21/20* (2006.01)

(52) U.S. Cl.
USPC ..... 399/92

(58) Field of Classification Search
USPC ..... 399/92, 93, 97
See application file for complete search history.

(56) References Cited

U.S. PATENT DOCUMENTS 6,266,498 B1 * 7/2001 Oda et al. ..... 399/92

FOREIGN PATENT DOCUMENTS

| | | | |
|---|---|---|---|
| JP | 60107047 A | * | 6/1985 |
| JP | 03105366 A | * | 5/1991 |
| JP | 11231760 A | * | 8/1999 |
| JP | A 2006-058695 | | 3/2006 |

* cited by examiner

*Primary Examiner* — Billy J Lactaoen
(74) *Attorney, Agent, or Firm* — Oliff & Berridge, PLC

(57) ABSTRACT

An exhaust apparatus includes a first exhausting section including a first exhausting member and a first flow path provided with an air inlet disposed above a heating device for heating a recording medium, a second exhausting section including a second exhausting member and a second flow path provided with an air inlet disposed downstream of the heating device in a transporting direction of the recording medium, and a third flow path provided with an air inlet disposed upstream of the heating device in the transporting direction. The first and second flow paths cause air in a housing that accommodates the heating device to flow to the outside. The first and second exhausting member exhaust the air using the first and second flow paths. The third flow path causes the air to flow from the air inlet thereof to the air inlet of the first flow path.

8 Claims, 11 Drawing Sheets

MULTI-PATH EXHAUST APPARATUS AND IMAGE FORMING APPARATUS

CROSS-REFERENCE TO RELATED APPLICATIONS

This application is based on and claims priority under 35 USC 119 from Japanese Patent Application No 2009-259277 filed Nov. 12, 2009.

BACKGROUND

The present invention relates to an exhaust apparatus and an image forming apparatus.

SUMMARY

According to an aspect of the present invention, an exhaust apparatus includes a first exhausting section including a first flow path and a first exhausting member, the first flow path being provided with an air inlet disposed above a heating device for heating a recording medium, the first flow path being configured to cause air in a housing that accommodates the heating unit to flow to the outside, the first exhausting member exhausting the air using the first flow path; a second exhausting section including a second flow path and a second exhausting member, the second flow path being provided with an air inlet disposed downstream of the heating device in a transporting direction in which the recording medium is transported, the second flow path being configured to cause the air in the housing to flow to the outside, the second exhausting member exhausting the air using the second flow path; and a third flow path being provided with an air inlet disposed upstream of the heating device in the transporting direction of the recording medium, the third flow path being configured to cause the air to flow from the air inlet of the third flow path to the air inlet of the first flow path.

BRIEF DESCRIPTION OF THE DRAWINGS

Exemplary embodiments of the present invention will be described in detail based on the following figures, wherein.

DETAILED DESCRIPTION

An exhaust apparatus and an image forming apparatus according to an exemplary embodiment of the present invention will now be described.

Figure 1:
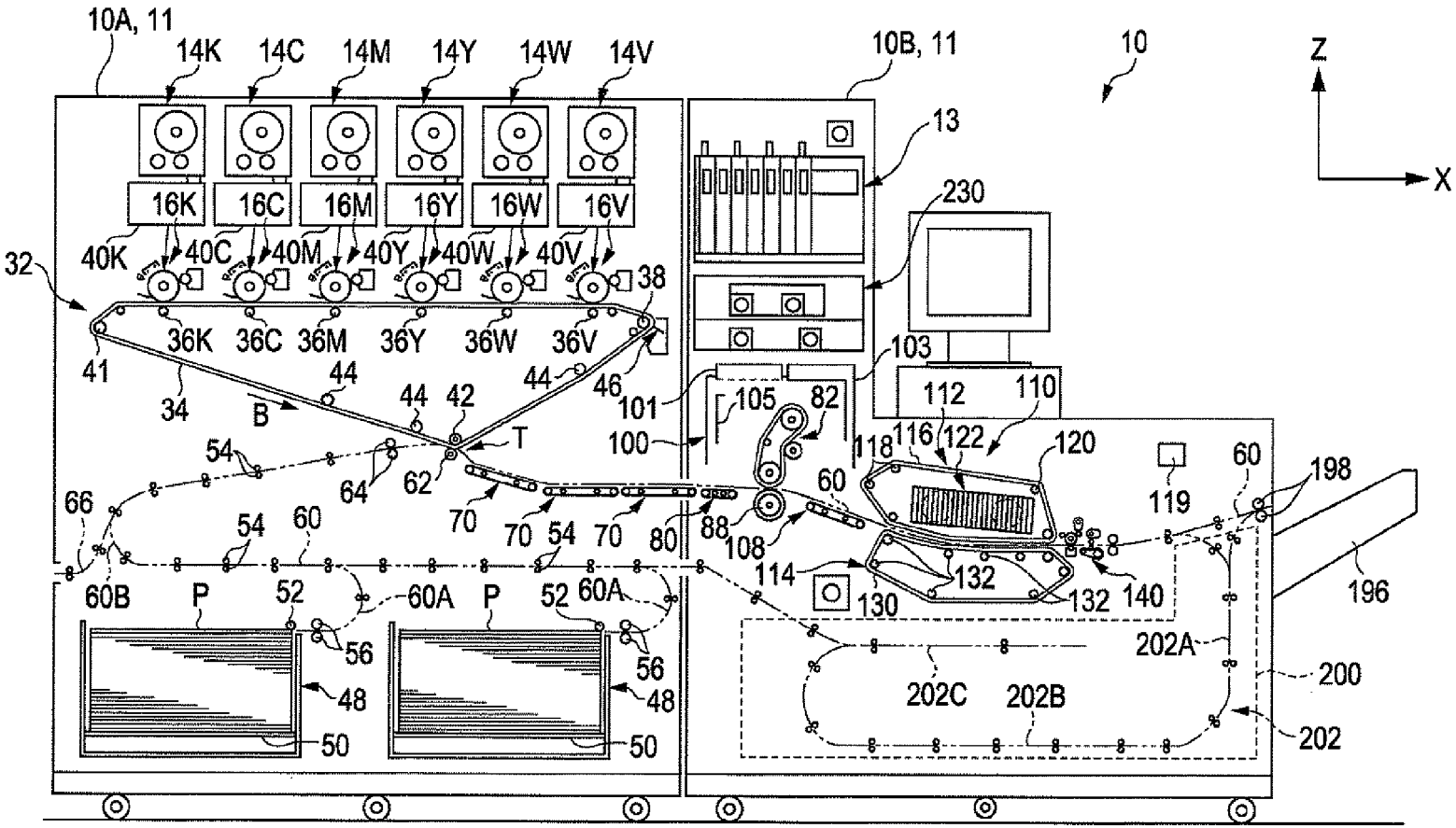
FIG. 1 is a diagram illustrating the overall structure of an image forming apparatus according to an exemplary embodiment of the present invention.

An image forming apparatus 10 according to the present exemplary embodiment forms color or monochrome images. As illustrated in FIG. 1, the image forming apparatus 10 includes a first processing section 10A disposed at the left side in a front view and a second processing section 10B disposed at the right side in the front view. The second processing section 10B is detachably attached to the first processing section 10A. Housings of the first processing section 10A and the second processing section 10B include frame members 11.

A control unit 13 is provided in the second processing section 10B at an upper section thereof in the vertical direction. The control unit 13 includes an image-signal processing unit that subjects image data transmitted from a computer to image processing. The control unit 13 is an example of a driving unit that drives each part of the image forming apparatus 10. A power supply unit 230 is provided below the control unit 13. The power supply unit 230 converts an externally supplied alternating current into a direct current and supplies power to each part of the image forming apparatus 10.

Toner cartridges 14V, 14W, 14Y, 14M, 14C, and 14K are arranged next to each other along the horizontal direction in the first processing section 10A at an upper section thereof in the vertical direction. The toner cartridges 14V, 14W, 14Y, 14M, 14C, and 14K are replaceable and contain toners of respective colors: a first specific color (V), a second specific color (W), yellow (Y), magenta (M), cyan (C), and black (K). The first and second specific colors are selected from specific colors (including transparent colors) other than yellow, magenta, cyan, and black. In the following descriptions, the letters 'V', 'W', 'Y', 'M', 'C', and 'K' are attached to reference numerals denoting components corresponding to V, W, Y, M, C, and K when they are to be distinguished from each other. The letters are omitted when it is not necessary to distinguish the components corresponding to V, W, Y, M, C, and K.

Six image forming units 16 are provided in a section below the toner cartridges 14. The image forming units 16 are an example of image forming units corresponding the respective colors of toner. The image forming units 16 are arranged next to each other along the horizontal direction such that the image forming units 16 correspond to the respective toner cartridges 14. Each image forming unit 16 includes an exposure unit 40, which is an example of an image forming unit, at a position below the corresponding toner cartridge 14. Each exposure unit 40 receives image data subjected to the image processing from the above-described control unit 13, modulates a semiconductor laser (not shown) in accordance with color tone data, and causes the semiconductor laser to emit exposure light L. More specifically, each exposure unit 40 forms an electrostatic latent image on a photosensitive member 18 (see FIG. 2), which will be described below, by irradiating the surface of the photosensitive member 18 with the exposure light L for the corresponding color.

Figure 2:
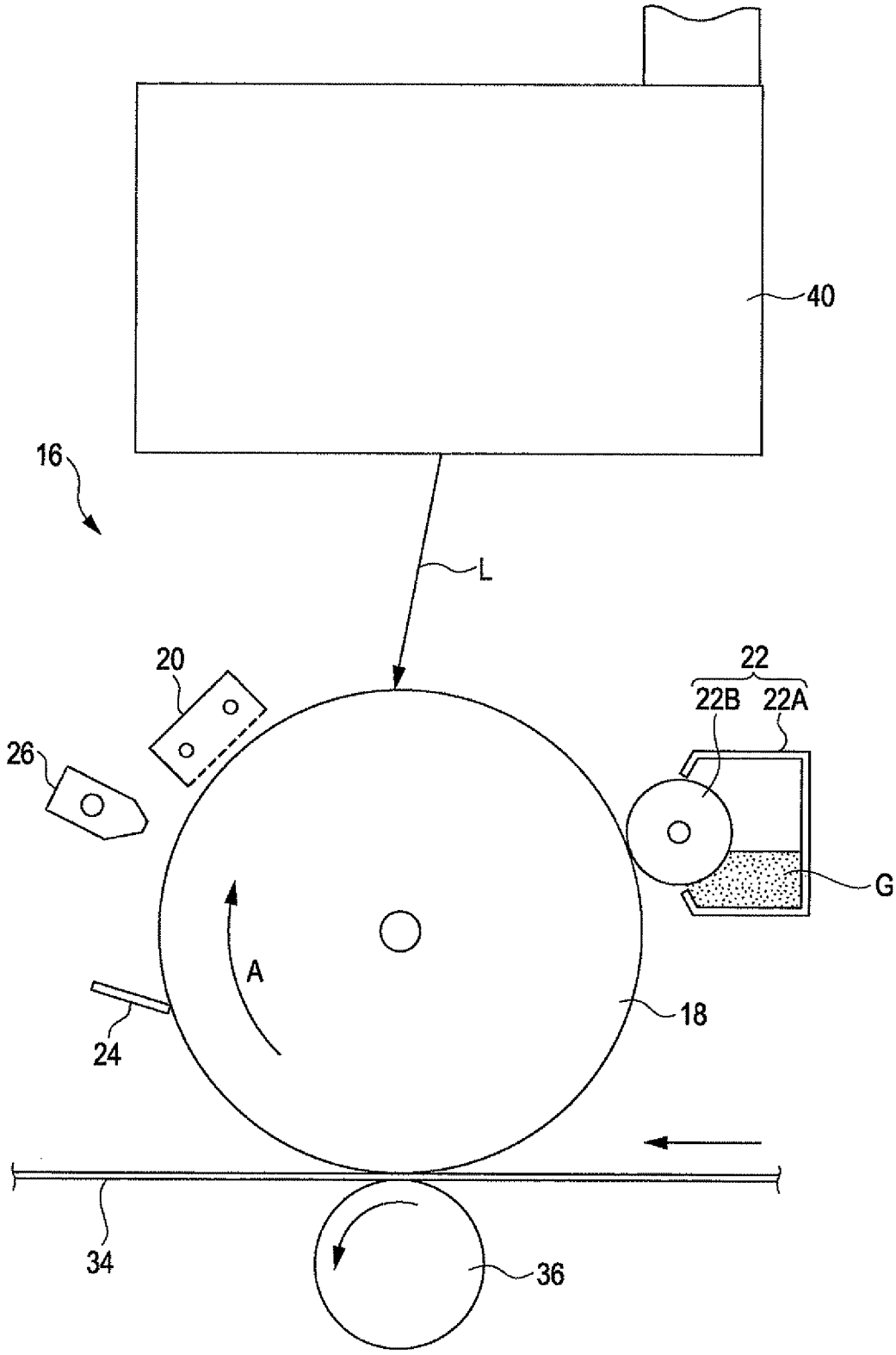
FIG. 2 is a diagram illustrating the structure of an image forming unit according to the exemplary embodiment of the present invention.

As illustrated in FIG. 2, each image forming unit 16 includes the photosensitive member 18, which is rotated in the direction shown by arrow A (clockwise in FIG. 2). A scorotron charging device 20, a developing device 22, a cleaning blade 24, and an erase lamp 26 are provided around each photosensitive member 18. The scorotron charging device 20 charges the photosensitive member 18 by a corona discharge method (non-contact charging method). The developing device 22 develops the electrostatic latent image formed on the photosensitive member 18 by the exposure light L emitted from the exposure unit 40 with a developing agent (toner) of the corresponding color. The cleaning blade 24 cleans the surface of the photosensitive member 18 after a transfer process. The erase lamp 26 eliminates the electric charge on the image photosensitive member 18 by irradiating the surface of the photosensitive member 18 with light after the transfer process. The scorotron charging device 20, the developing device 22, the cleaning blade 24, and the erase lamp 26 face the surface of the photosensitive member 18, and are arranged in that order in a direction from an upstream position to a downstream position along the rotating direction of the photosensitive member 18.

The developing device 22 is disposed on one side (on the right side in FIG. 2 in the present exemplary embodiment) of the image forming unit 16. The developing device 22 includes a developing-agent container 22A that is filled with a developing agent G including toner and a developing roller 22B that supplies the toner contained in the developing-agent container 22A to the surface of the photosensitive member 18. The developing-agent container 22A is connected to the corresponding toner cartridge 14 (see FIG. 1) by a toner supply path (not shown), and receives the toner from the toner cartridge 14.

As illustrated in FIG. 1, a transfer unit 32 is provided below the image forming units 16. The transfer unit 32 includes an endless intermediate transfer belt 34 that is in contact with the photosensitive members 18 and six first transfer rollers 36 disposed inside the intermediate transfer belt 34. The first transfer rollers 36 serve as first transfer members for transferring toner images formed on the respective photosensitive members 18 onto the intermediate transfer belt 34 in a superimposed manner. The intermediate transfer belt 34 is wrapped around a driving roller 38 driven by a motor (not shown), a tension-applying roller 41 that adjusts a tension applied to the intermediate transfer belt 34, a support roller 42 that is opposed to a second transfer roller 62, which will be described below, and support rollers 44. The intermediate transfer belt 34 is rotated in the direction shown by arrow B shown in FIG. 1 (counterclockwise) by the driving roller 38.

More specifically, each first transfer roller 36 is opposed to the photosensitive member 18 in the corresponding image forming unit 16 with the intermediate transfer belt 34 interposed therebetween. A transfer bias voltage with a polarity opposite to the polarity of the toner is applied to each first transfer roller 36 by an electricity supplying unit (not shown). Accordingly, the toner image formed on each photosensitive member 18 is transferred onto the intermediate transfer belt 34. In addition, a cleaning blade 46 is disposed opposite the driving roller 38 across the intermediate transfer belt 34. The cleaning blade 46 has an end portion that is in contact with the intermediate transfer belt 34, and removes toner, paper dust, etc., that remain on the intermediate transfer belt 34 that is being rotated.

Two large paper feed cassettes 48 that contain sheet members P, which are an example of recording media, are arranged next to each other along the horizontal direction in a section below the transfer unit 32 in the first processing section 10A. A large number of sheet members P are stored in the paper feed cassettes 48. The two paper feed cassettes 48 have a similar structure. Therefore, only one of the paper feed cassettes 48 will be described herein, and explanations of the other paper feed cassette 48 will be omitted.

Each paper feed cassette 48 can be pulled out from the first processing section 10A. When the paper feed cassette 48 is pulled out from the first processing section 10A, a bottom plate 50, which is disposed in the paper feed cassette 48 and on which the sheet members P are stacked, is moved downward in response to a command from a controller (not shown). When the bottom plate 50 is moved downward, a user can refill the paper feed cassette 48 with the sheet members P. Then, when the paper feed cassette 48 is attached to the first processing section 10A again, the bottom plate 50 is moved upward in response to a command from the controller. Each paper feed cassette 48 is provided with a feed roller 52 at one end of the paper feed cassette 48 in an upper section thereof. The feed roller 52 feeds the sheet members P from the paper feed cassette 48 into a transport path 60, and is in contact with the topmost one of the sheet members P stacked on the bottom plate 50 that has been moved upward. In addition, separation rollers 56 are provided downstream of each feed roller 52 in a sheet-member transporting direction (hereinafter sometimes described simply as "downstream"). The separation rollers 56 prevent the sheet members P from being fed while the sheet members P are stacked on each other. Transporting rollers 54 that transport the sheet members P downstream in the transporting direction are provided downstream of the separation rollers 56.

The transport path 60 is provided above the paper feed cassettes 48. The transport path 60 extends to a transfer position T between the second transfer roller 62 and the support roller 42, and includes first turning portions 60A at which the sheet members P fed from the paper feed cassettes 48 are turned over to the left in FIG. 1 and a second turning portion 60B at which the sheet members P are turned over to the right in FIG. 1.

An aligner (not shown) which corrects the inclination and the like of the sheet member P that is being transported is disposed at a position between the second turning portion 60B and the transfer position T. Positioning rollers 64 for matching the timing between the movement of the toner images on the intermediate transfer belt 34 and the movement of the sheet member P that is being transported are provided between the aligner and the transfer position T.

A transfer bias voltage with a polarity opposite to the polarity of the toner is applied to the second transfer roller 62 by the electricity supplying unit (not shown). With this structure, the toner images of the respective colors that have been transferred onto the intermediate transfer belt 34 in a superimposed manner are transferred by the second transfer roller 62 onto the sheet member P that has been transported along the transport path 60. An auxiliary path 66 extends from a side surface of the first processing section 10A and joins the second turning portion 60B of the transport path 60. Accordingly, sheet members P fed from an external large-capacity container (not shown) that is disposed next to the first processing section 10A can be fed into the transport path 60 through the auxiliary path 66.

Transporting devices 70 for transporting the sheet members P onto which the toner images have been transferred to the second processing section 10B are provided downstream of the transfer position T. The transporting devices 70 include belt members, each of which is wrapped around a driving roller and a driven roller (not shown). The driving rollers rotate to move the belt members, thereby transporting the sheet member P downstream.

A downstream section of the transporting devices 70 extends from the first processing section 10A to the second processing section 10B, and the sheet member P that has been transported by the transporting devices 70 is received and further transported downstream by a transporting device 80 provided in the second processing section 10B. A fixing unit 82 is provided downstream of the transporting device 80. The fixing unit 82 is an example of a fixing device that fixes the toner images that have been transferred onto the surface of the sheet member P by application of heat and pressure. An exhaust apparatus 100, which will be described below, is provided so as to so surround the fixing unit 82.

Figure 3:
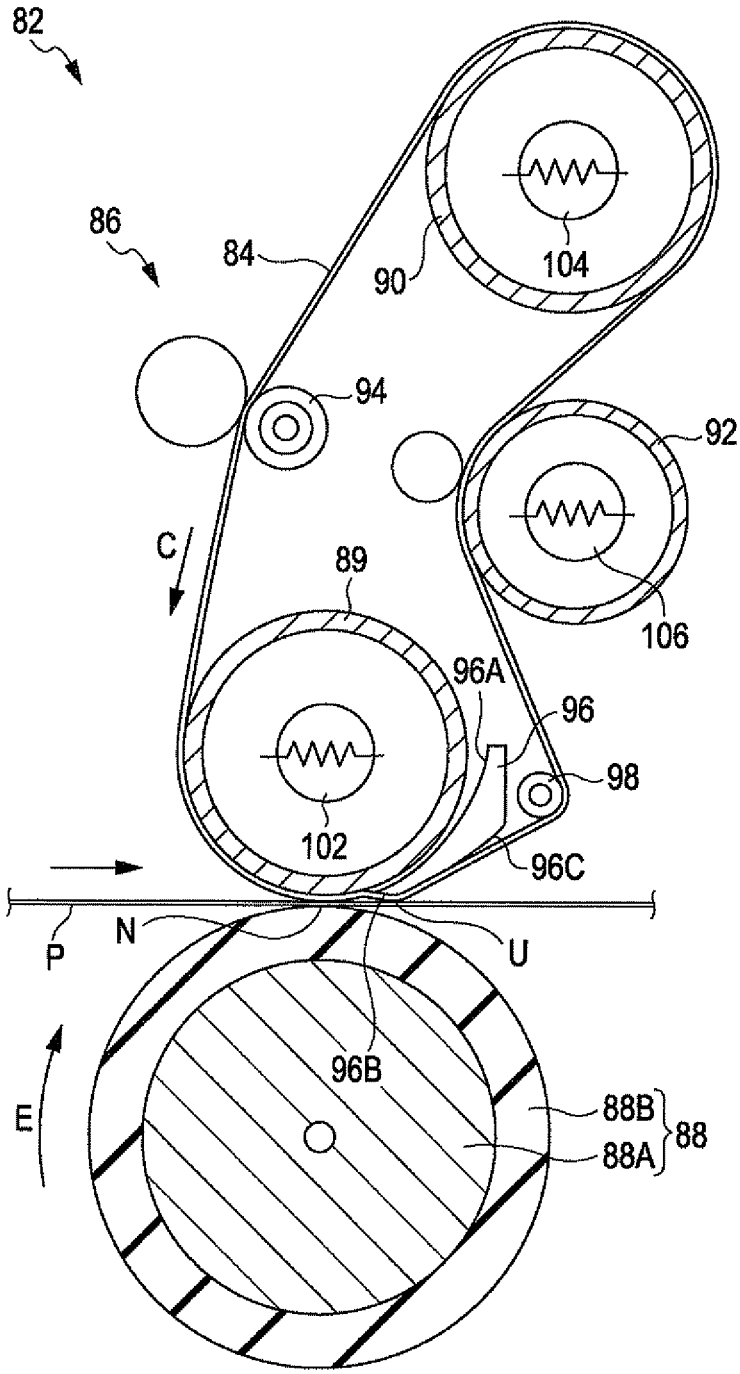
FIG. 3 is a diagram illustrating the structure of a fixing unit according to the exemplary embodiment of the present invention.

As illustrated in FIG. 3, the fixing unit 82 includes a fixing belt module 86 including a fixing belt 84 and a pressing roller 88 disposed such that the pressing roller 88 is in pressure contract with the fixing belt module 86. The fixing belt 84 (the fixing belt module 86), which will be described below, and the pressing roller 88 are in contact with each other to form a nip section N therebetween. Pressure and heat is applied to the sheet member P in the nip section N, and the toner images are fixed accordingly.

The fixing belt module 86 includes the fixing belt 84, which is an endless belt; a heating roller 89 around which the fixing belt 84 is wrapped at a position adjacent to the pressing roller 88 and which is rotated by a rotating force applied by a motor (not shown); and a support roller 90 around which the fixing belt 84 is wrapped at a position different from the position at which the fixing belt 84 is wrapped around the heating roller 89. The fixing belt module 86 also includes a support roller 92 disposed outside the fixing belt 84 to define the path along which the fixing belt 84 is rotated and a position-adjusting roller 94 which corrects the position of a portion the fixing belt 84 that extends from the heating roller 89 to the support roller 90.

A separation pad 96 and a support roller 98 are disposed inside the fixing belt 84 in an area downstream of the nip section N in which the fixing belt module 86 and the pressing roller 88 are in pressure contact with each other. The separation pad 96 is disposed near the heating roller 89 and separates the fixing belt 84 from the outer peripheral surface of the heating roller 89. The fixing belt 84 is wrapped around the support roller 98 at a position downstream of the nip section N.

The heating roller 89 is a hard roller obtained by coating the surface a cylindrical core made of aluminum with a fluoropolymer film having a thickness of 200 μm. The fluoropolymer film serves as a protecting layer for preventing metal wearing at the surface of the core. A halogen heater 102 is provided inside the heating roller 89. The support roller 90 is a cylindrical roller made of aluminum, and a halogen heater 104 is provided inside the support roller 90 as a heat source for heating the fixing belt 84 from the inner side thereof. In addition, spring members (not shown) for pushing the fixing belt 84 outward are provided at either end of the support roller 90.

The support roller 92 is a cylindrical roller made of aluminum, and a releasing layer made of fluoropolymer and having a thickness of 20 μm is formed on the surface of the support roller 92. The releasing layer is formed to prevent offset toner, paper dust, etc., from the outer peripheral surface of the fixing belt 84 from collecting on the support roller 92. A halogen heater 106 is provided inside the support roller 92 to heat the fixing belt 84 from the outer side thereof. According to the present exemplary embodiment, the fixing belt 84 is heated by the heating roller 89, the support roller 90, and the support roller 92.

The position-adjusting roller 94 is a columnar roller made of aluminum, and an end-position measurement mechanism (not shown) for measuring an end position of the fixing belt 84 is disposed near the position-adjusting roller 94. The position-adjusting roller 94 is provided with an axial-position moving mechanism (not shown) that moves the contact position of the fixing belt 84 in an axial direction in accordance with the measurement result obtained by the end-position measurement mechanism. Accordingly, meandering of the fixing belt 84 can be prevented.

The separation pad 96 is, for example, a block-shaped member formed of a rigid body made of an iron-based metal, resin, etc., and has a length corresponding to the length of the heating roller 89. The cross-section of the separation pad 96 is substantially arc-shaped and includes a curved inner surface 96A that faces the heating roller 89, a pushing surface 96B that pushes the fixing belt 84 toward the pressing roller 88, and an outer surface 96C that is at a predetermined angle with respect to the pushing surface 96B and that serves to set the fixing belt 84 in a bent state. More specifically, an angular portion U between the pushing surface 96B and the outer surface 96C sets the fixing belt 84, which is pressed against the angular portion U owing to the pressing roller 88, in a bent state so that a leading end portion of the sheet member P can be separated from the fixing belt 84 when the leading end portion of the sheet member P passes the angular portion U.

The pressing roller 88 includes a columnar roller 88A made of aluminum as a base member. An elastic layer 88B made of silicone rubber and a separation layer made of fluoropolymer and having a thickness of 100 μm are stacked in that order on the base member. The pressing roller 88 is supported in a rotatable manner, and is pressed by an urging unit (not shown), such as a spring, against a portion of the fixing belt 84 that is wrapped around the heating roller 89. Accordingly, when the heating roller 89 included in the fixing belt module 86 rotates in the direction shown by arrow C, the heating roller 89 is rotated in the direction shown by arrow E by the rotation of the heating roller 89.

Figure 4:
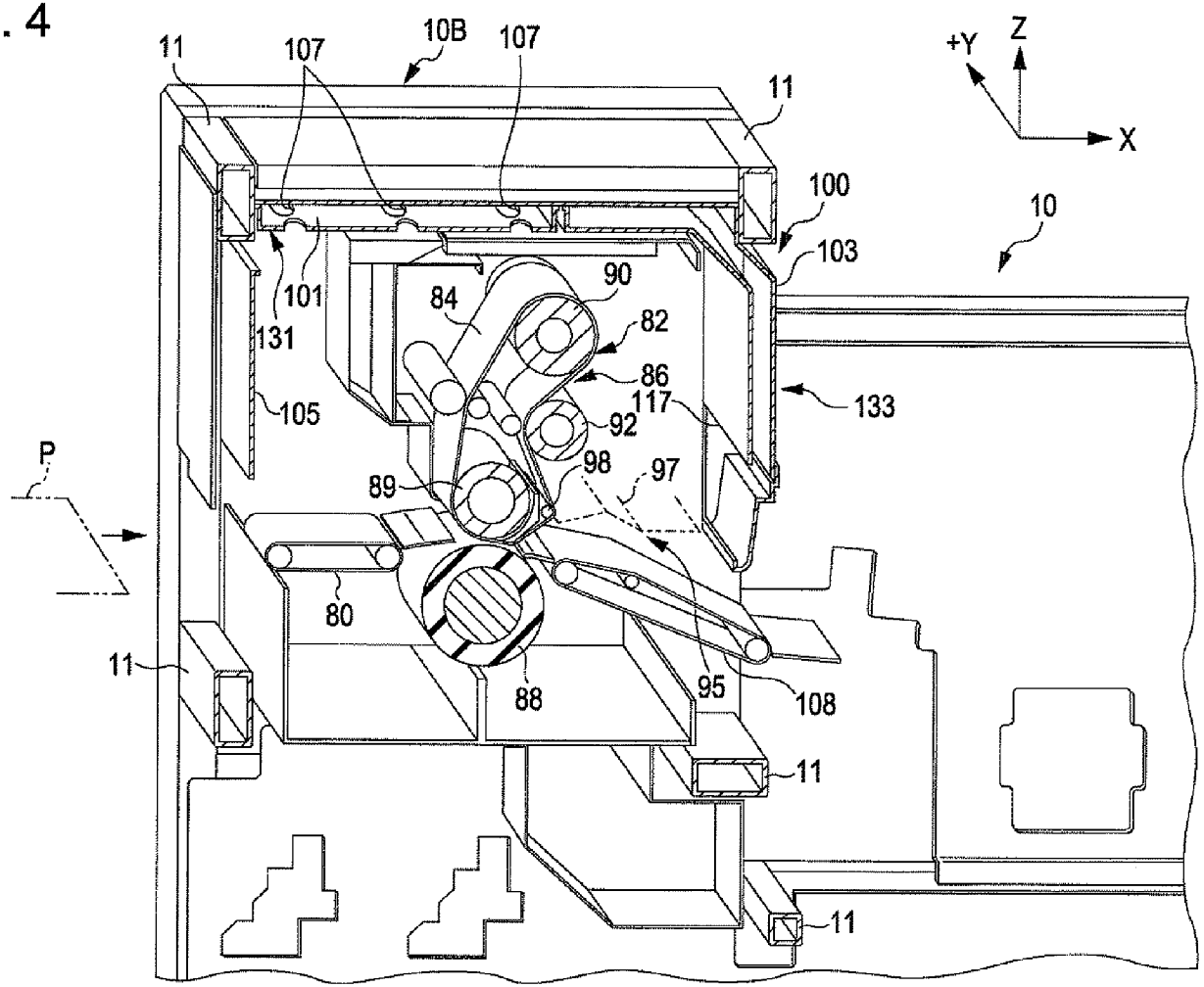
FIG. 4 is a diagram illustrating the structures of the fixing unit and an exhaust apparatus according to the exemplary embodiment of the present invention.

As illustrated in FIG. 4, a top plate 97, which defines a ceiling of a transport path of the sheet member P, is disposed near the support roller 98 at a side of the fixing unit 82 at which the sheet member P is ejected. The top plate 97 is opposed to a transporting device 108, which will be described below, and the space between the top plate 97 and the transporting device 108 functions as an ejection section 95 to which the sheet member P is ejected.

As illustrated in FIG. 1, the transporting device 108 is provided downstream of the fixing unit 82. The transporting device 108 transports the sheet member P ejected from the fixing unit 82 downstream. A cooling unit 110 that cools the sheet member P heated by the fixing unit 82 is provided downstream of the transporting device 108. The cooling unit 110 includes an absorbing device 112 that absorbs heat from the sheet member P and a pressing device 114 that presses the sheet member P against the absorbing device 112. The absorbing device 112 and the pressing device 114 are disposed at an upper side and a lower side, respectively, of the transport path 60. A de-curling unit 140 that flattens the sheet member P, which may be curled, is provided downstream of the cooling unit 110.

The absorbing device 112 includes an endless absorbing belt 116 that comes into contact with the sheet member P to absorb heat from the sheet member P. Support rollers 118 that support the absorbing belt 116 and a driving roller 120 that transmits a driving force to the absorbing belt 116 are disposed inside the absorbing belt 116. In addition, a heat sink 122 made of an aluminum material is also disposed inside the absorbing belt 116. The heat sink 122 comes into surface contact with the absorbing belt 116 and dissipates the heat absorbed by the absorbing belt 116.

The pressing device 114 includes an endless pressing belt 130 that comes into contact with the sheet member P and presses the sheet member P against the absorbing device 112 and support rollers 132 around which the pressing belt 130 is wrapped and which are supported in a rotatable manner. With this structure, the heat of the sheet member P is dissipated and the sheet member P is cooled.

Ejection rollers 198 are provided downstream of the de-curling unit 140. The ejection rollers 198 eject the sheet member P having an image formed on one side thereof to an ejection unit 196 attached to a side surface of the second processing section 10B. In addition, a temperature-humidity sensor 119 is provided above the de-curling unit 140. The temperature-humidity sensor 119 is an example of a temperature-humidity measuring unit that measures the temperature and humidity in the second processing section 10B or the temperature and humidity outside the second processing section 10B and outputs the data of the temperature and humidity to the control unit 13. In the case where images are to be formed on both sides of the sheet member P, the sheet member P is transported to a reversing unit 200 provided downstream of the de-curling unit 140.

The reversing unit 200 includes a reversing path unit 202. The reversing path unit 202 includes a branching path 202A that branches from the transport path 60, a sheet-transport path 202B along which the sheet member P transported from the branching path 202A is transported toward the first processing section 10R, and a reversing path 202C along which the sheet member P transported from the sheet-transport path 202B is turned over and transported in a switchback manner to reverse the sheet member P. With this structure, the sheet member P transported along the reversing path 202C in a switchback manner is transported toward the first processing section 10A and enters the transport path 60 disposed above the paper feed cassettes 48. Thus, the sheet member P is transported to the transfer position T again.

The exhaust apparatus 100 will now be described.

FIG. 4 illustrates the exhaust apparatus 100 provided so as to surround the fixing unit 82. In FIG. 4, the direction shown by arrow X is the direction from the left side to the right side of the image forming apparatus 10, and the direction shown by arrow +Y is the direction from the front side to the back side of the image forming apparatus 10.

The exhaust apparatus 100 includes a first exhaust unit 131 as an example of a first exhausting section, a second exhaust unit 133 as an example of a second exhausting section, and a third duct 105 as an example of a third flow path. The third duct 105 is arranged so as to cover a section upstream of the fixing unit 82 in the transporting direction of the sheet member P. The first exhaust unit 131 includes a first duct 101 as an example of a first flow path, and also includes an auxiliary duct 109 and a first exhaust fan 113 (see FIG. 6) which will be described below. The first duct 101 is arranged so as to cover an upper section of the fixing unit 82. The second exhaust unit 133 includes a second duct 103 as an example of a second flow path, and also includes an auxiliary duct 111 and a second exhaust fan 115 (see FIG. 6) which will be described below. The second duct 103 is L-shaped in cross section and is arranged so as to cover a section downstream of the fixing unit 82 in the transporting direction of the sheet member P.

Figure 6:
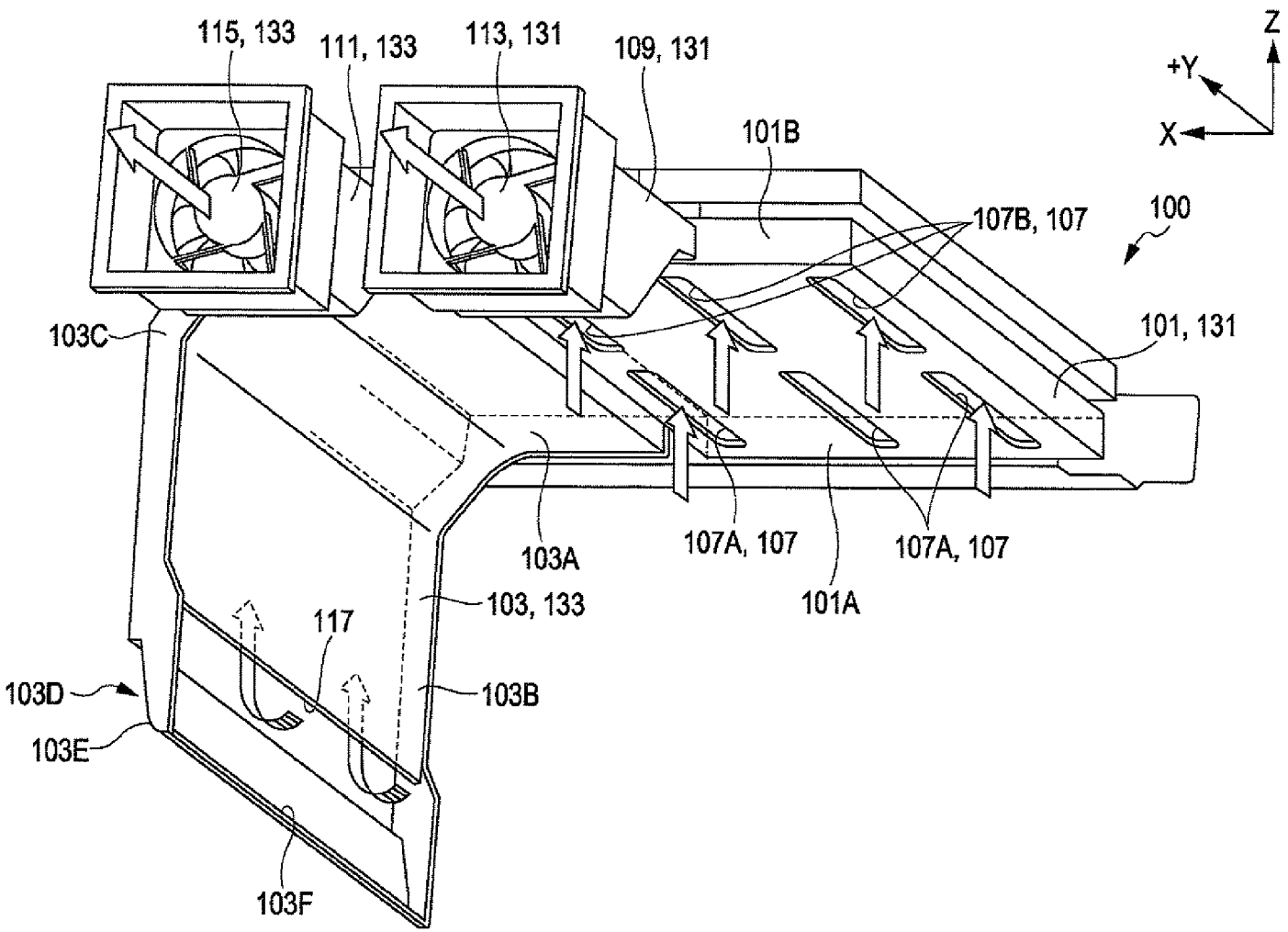
FIG. 6 is a perspective view of the exhaust apparatus according to the exemplary embodiment of the present invention viewed from the back side of the image forming apparatus.
Figure 7:
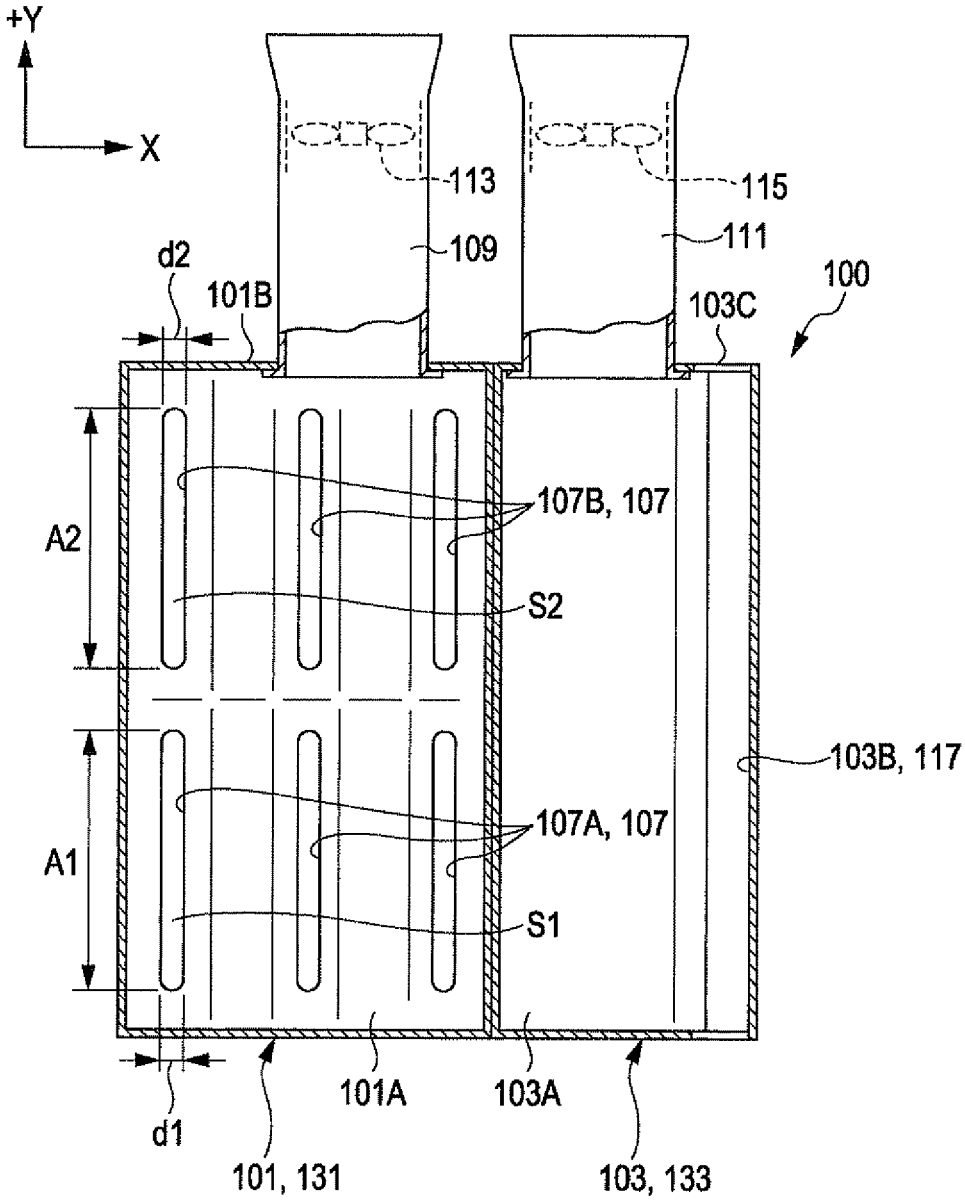
FIG. 7 is a plan view illustrating the structure of the exhaust apparatus according to the exemplary embodiment of the present invention.

As shown in FIGS. 6 and 7, the cross section of the first duct 101 is shaped like a rectangular tube that extends in the direction shown by arrow +Y. Air inlets 107 are formed in a bottom portion 101A of the first duct 101. The air inlets 107 are long holes that extend in the direction shown by arrow +Y, which crosses the transporting direction of the sheet member P (direction shown by arrow X). The air inlets 107 include air inlets 107A formed in a front section with respect to the direction shown by arrow +Y and air inlets 107B formed in a back section with respect to the direction shown by arrow +Y. The air inlets 107A and the air inlets 107B are disposed next to each other along straight lines, and have the same dimensions. When A1 is the length of the air inlets 107A in the direction shown by arrow +Y, d1 is the length of the air inlets 107A in the direction shown by arrow X, A2 is the length of the air inlets 107B in the direction shown by arrow +Y, and d2 is the length of the air inlets 107B in the direction shown by arrow X, the air inlets 107A and 107B are formed such that the opening area S1 (≅A1×d1) of the air inlets 107A is equal to or substantially equal to the opening area S2 (≅A2×d2) of the air inlets 107B.

The second duct 103 includes an exhausting potion 103A that continues from the first duct 101 and extends in the direction shown by arrow X and an exhausting potion 103B that continues from en end of the exhausting potion 103A and extends downward in the direction opposite to the direction shown by arrow Z. An air inlet 117 that opens toward the ejection section 95 (see FIG. 8) of the fixing unit 82 is provided at the lower end of the exhausting potion 103B. A guiding member 1030 is provided at the lower end of the air inlet 117. The guiding member 103D continues from the air inlet 117, and at least a portion of the guiding member 103D is curved so as to guide the air that flows from the upstream region in the transporting direction of the sheet member P toward the air inlet 117.

Figure 8:
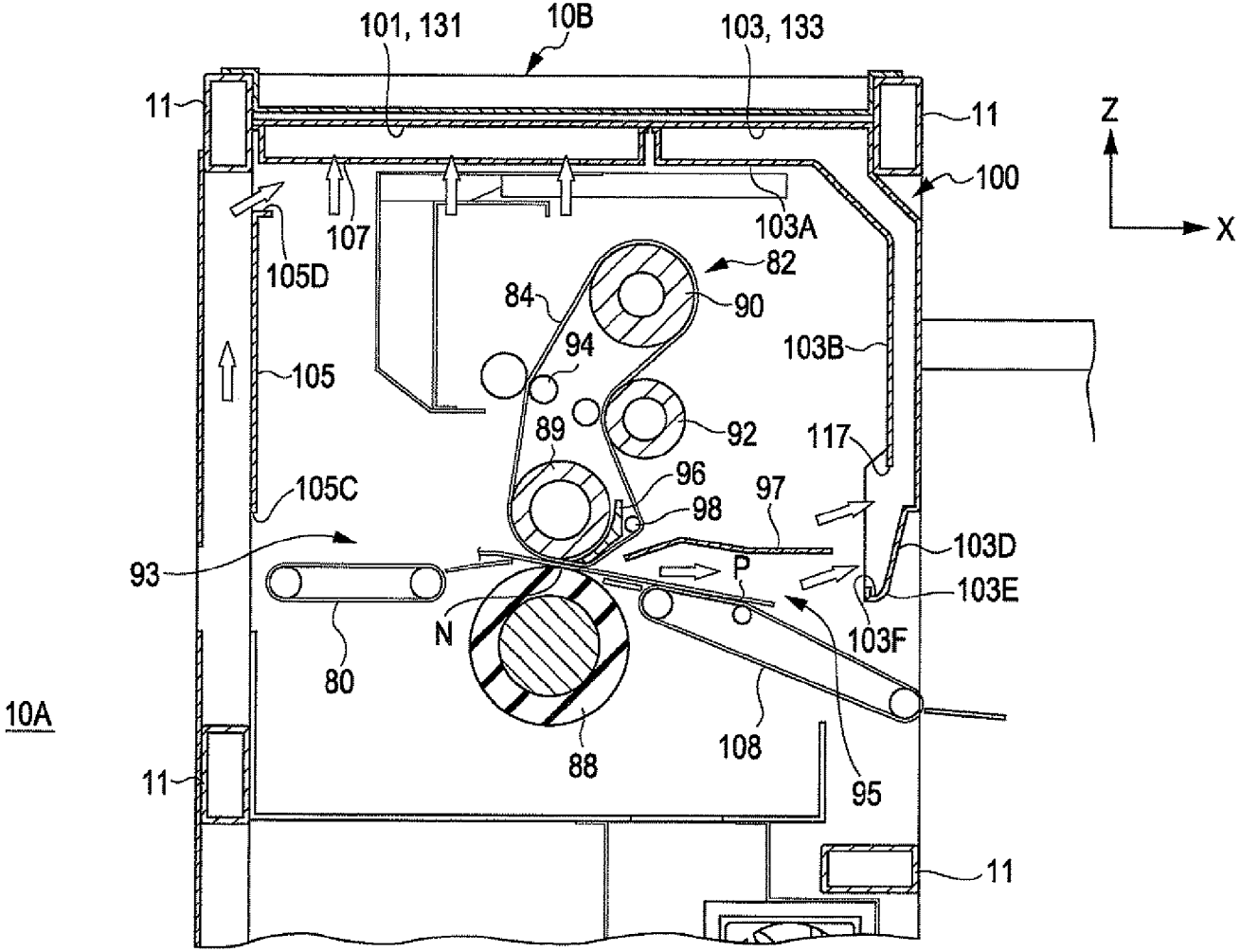
FIG. 8 is a diagram illustrating the state in which air is sucked by the exhaust apparatus according to the exemplary embodiment of the present invention.

As shown in FIG. 8, a portion of the guiding member 103D of the second duct 103 is inclined toward the ejection section 95. In addition, the guiding member 103D includes a curved wall portion 103E that changes the direction in which the air flows from the direction shown by arrow X to the direction shown by arrow Z. A recessed stopping portion 103F for receiving water droplets formed by condensation is formed by bending the wall portion 103E upward at an end thereof.

As illustrated in FIG. 7, the auxiliary duct 109, which is also an example of a first flow path, is attached to an end portion 101B of the first duct 101 in the direction shown by arrow +Y. The auxiliary duct 109 extends in the direction shown by arrow +Y from the end portion 101B. The auxiliary duct 111, which is also an example of a second flow path, is attached to an end portion 103C of the second duct 103 in the direction shown by arrow +Y. The auxiliary duct 111 extends in the direction shown by arrow +Y from the end portion 103C.

The first exhaust fan 113, which is an example of a first exhausting member, is provided in the auxiliary duct 109. The first exhaust fan 113 sucks in air through the air inlets 107 and exhausts the air in the first duct 101 and the auxiliary duct 109 to the outside of the second processing section 10B (see FIG. 1). The second exhaust fan 115, which is an example of a second exhausting member, is provided in the auxiliary duct 111. The second exhaust fan 115 sucks in air through the air inlet 117 and exhausts the air in the second duct 103 and the auxiliary duct 111 to the outside of the second processing section 10B (see FIG. 1).

The first exhaust fan 113 and the second exhaust fan 115 are electrically connected to the control unit 13 (see FIG. 1), and are driven independently of each other on the basis of the data of the temperature or humidity obtained by the temperature-humidity sensor 119. In the case where, for example, the temperature detected by the temperature-humidity sensor 119 is 25° C., the amount of air (airflow) exhausted by the first exhaust fan 113 is increased from a preset amount and the amount of air (airflow) exhausted by the second exhaust fan 115 is reduced from a preset amount. In the case where, for example, the humidity detected by the temperature-humidity sensor 119 is 60%, the amount of air (airflow) exhausted by the second exhaust fan 115 is increased from the preset amount and the amount of air (airflow) exhausted by the first exhaust fan 113 is reduced from the preset amount.

Figure 10:
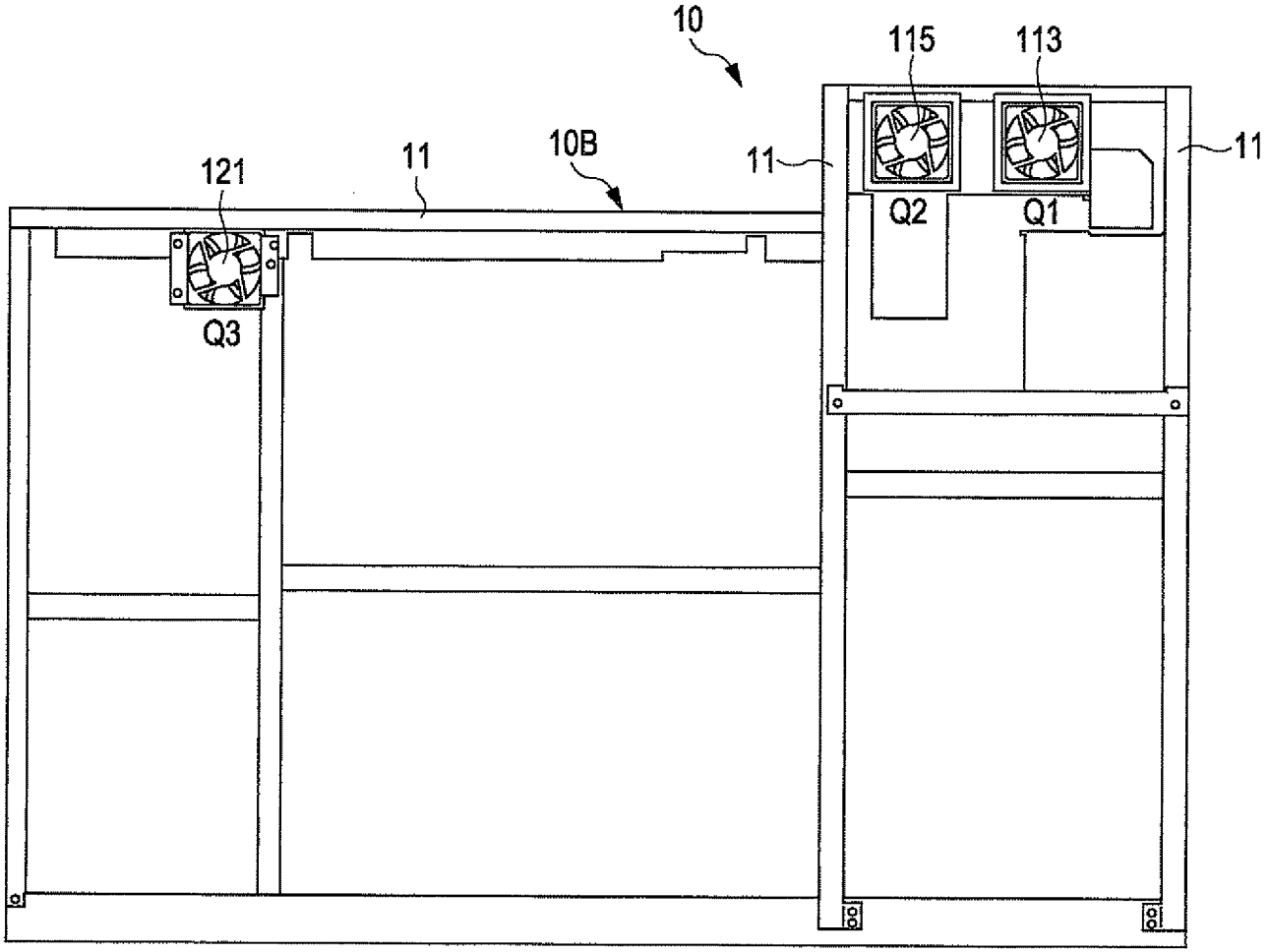
FIG. 10 is a diagram illustrating the state in which exhaust fans are arranged when a second processing section of the image forming apparatus according to the exemplary embodiment of the present invention is viewed from the back side.

As illustrated in FIG. 10, a third exhaust fan 121, which is an example of a third exhausting member, is provided at a back side of the second processing section 10B (back side of the image forming apparatus 10). The third exhaust fan 121 is driven and controlled by the control unit 13 (see FIG. 1) so as to suck in air from an area around the de-curling unit 140 and exhaust the air to the outside of the second processing section 10B. The first exhaust fan 113 and the second exhaust fan 115 are driven and controlled independently of each other by the control unit 13 (see FIG. 1), but are set such that the sum of the amount of air (represented by Q1) exhausted by the first exhaust fan 113 and the amount of air (represented by Q2) exhausted by the second exhaust fan 115 is larger than the amount of air (represented by Q3) exhausted by the third exhaust fan 121. In other words, Q1+Q2>Q3 is satisfied.

Figure 5:
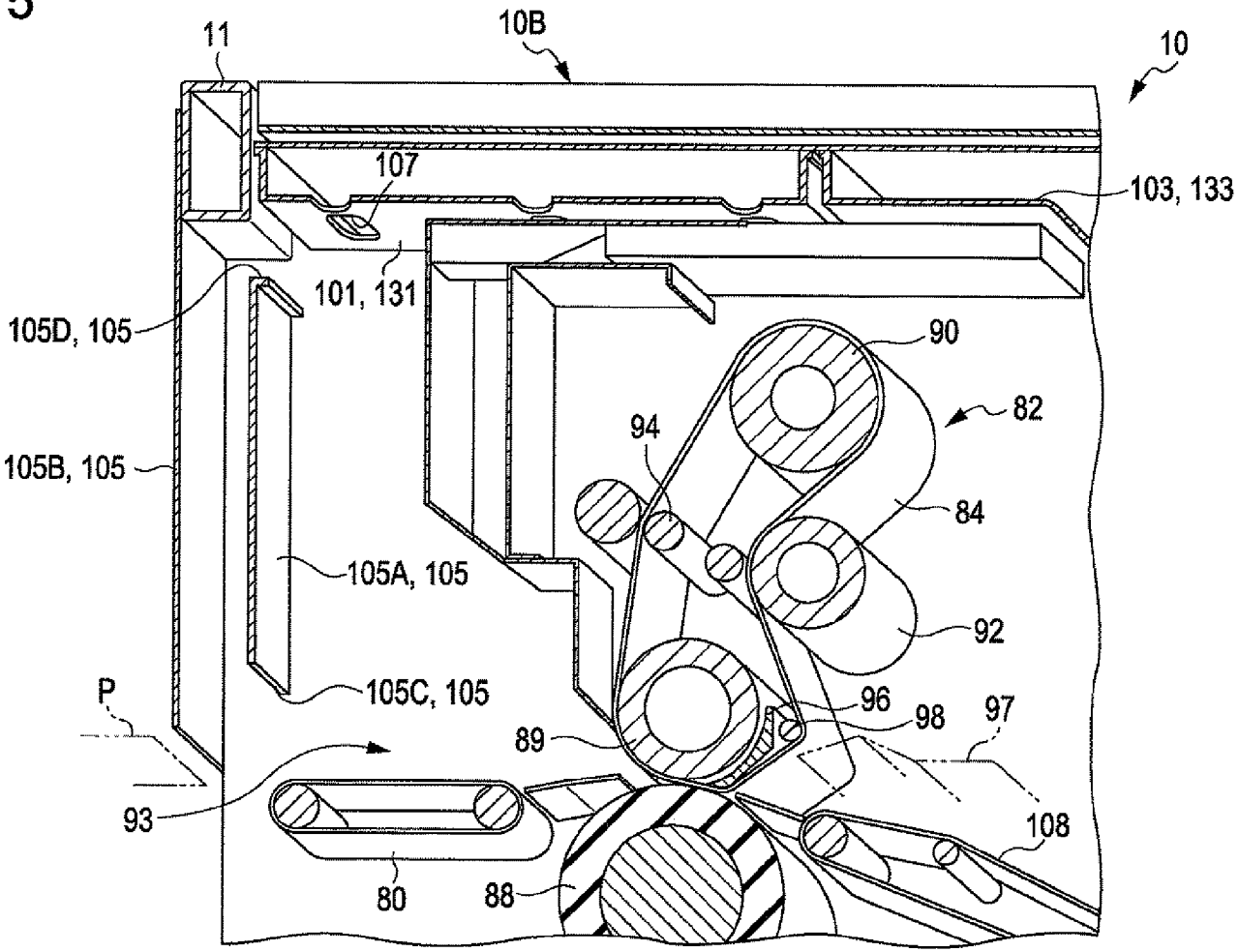
FIG. 5 is a diagram illustrating a part of the structures of the fixing unit and the exhaust apparatus according to the exemplary embodiment of the present invention.

As illustrated in FIG. 5, the third duct 105 includes a side plate 105A and an outer wall 105B (a part of the second processing section 10B) of the image forming apparatus 10. The side plate 105A and the outer wall 105B face each other in the transporting direction of the sheet member P at positions above a section upstream of the transporting device 80 in the transporting direction. The side plate 105A is positioned closer to the fixing unit 82 than the outer wall 105B, and the lower end of the side plate 105A is positioned above the lower end of the outer wall 105B, so that an air inlet 105C through which air is sucked is provided at the bottom of the third duct 105. In addition, an upper portion of the side plate 105A is shorter than that of the outer wall 105B, so that an air outlet 105D through which the air is discharged is provided at the top of the third duct 105. The air outlet 105D is positioned near the air inlets 107 in the first duct 101, so that the air flows from an entrance section 93, through which the sheet member P is transported to the fixing unit 82 (space above the transporting device 80), to the air inlets 107. The entrance section 93 of the fixing unit 82 is covered by the outer wall 1058, so that the fixing unit 82, which may be in a high-temperature state, is prevented from being touched.

The operation of the present exemplary embodiment will now be described.

First, an image forming process performed by the image forming apparatus 10 will be described.

Referring to FIG. 1, when each unit in the image forming apparatus 10 is set to an operating state, the image data subjected to the image processing performed by the control unit 13 is converted into color tone data for each color, and is transmitted to the exposure units 40. Each exposure unit 40 emits the exposure light L in accordance with the color tone data for the corresponding color to scan the corresponding photosensitive member 18, which has been charged by the scorotron charging device 20 (see FIG. 2), with the exposure light L. As a result, an electrostatic latent image is formed on each photosensitive member 18. The electrostatic latent image formed on each photosensitive member 18 (see FIG. 2) is developed by the developing device 22. Thus, the toner images (developing agent images) of the respective colors, that is, the first specific color (V), the second specific color (W), yellow (Y), magenta (M), cyan (C), and black (K), are formed.

Subsequently, the toner images of the respective colors formed on the photosensitive members 18 included in the image forming units 16V, 16W, 16Y, 16M, 160, and 16K are transferred onto the intermediate transfer belt 34 in a superimposed manner by the six first transfer rollers 36V, 36W, 36Y, 36M, 36C, and 36K. The toner images of the respective colors that have been transferred onto the intermediate transfer belt 34 in a superimposed manner are transferred by the second transfer roller 62 onto the sheet member P that has been transported from one of the paper feed cassettes 48. The sheet member P onto which the toner images have been transferred is transported by the transporting devices 70 toward the fixing unit 82 provided in the second processing section 10B.

Then, the toner images of the respective colors on the sheet member P are fixed on the sheet member P by being heated and pressed by the fixing unit 82. The sheet member P on which the toner images have been fixed is cooled when the sheet member P passes through the cooling unit 110, and is transported to the de-curling unit 140, where the sheet member P in the curled state is flattened. After the sheet member P in the curled state is flattened, the sheet member P is ejected to the ejection unit 196 by the ejection rollers 198.

In the case where an image is to be formed on the surface on which no image has been formed (in the case of duplex printing), the sheet member P is transported to the reversing unit 200 by a switching member (not shown). The sheet member P transported to the reversing unit 200 is reversed when the sheet member P passes through the reversing path unit 202, and is transported to the transport path 60 disposed above the paper feed cassettes 48. Then, toner images are formed on the back side of the sheet member P by the above-described process.

An exhausting operation performed by the exhaust apparatus 100 will now be described.

Referring to FIG. 1, when the image forming apparatus 10 is activated, the temperature-humidity sensor 119 measures the temperature and humidity outside the second processing section 10B. The control unit 13 compares the measurement data of the temperature and humidity with set values of the temperature and humidity that are stored in advance. If the temperature is higher than the set value, the rotational speed of the first exhaust fan 113 (see FIG. 6) is increased to increase the amount of air exhausted by the first exhaust fan 113. In the case where the humidity is higher than the set value, the rotational speed of the second exhaust fan 115 (see FIG. 6) is increased to increase the amount of air exhausted by the second exhaust fan 115. In this case, when the amount of air exhausted by one of the first exhaust fan 113 and the second exhaust fan 115 is increased, the amount of air exhausted by the other one of the first exhaust fan 113 and the second exhaust fan 115 is reduced from the set value. Thus, variation in the total amount of air (airflow) exhausted by the first exhaust fan 113 and the second exhaust fan 115 and variation in power consumption can be suppressed.

Referring to FIG. 8, when the fixing unit 82 starts to perform a fixing operation, the air surrounding the fixing unit 82 is heated by the heat generated by the halogen heater 102 (see FIG. 3) and other components and the temperature of the air is increased. At this time, the pressure in the first duct 101 is lower (closer to vacuum) than the pressure in the area around the fixing unit 82, owing to the exhausting operation performed by the first exhaust fan 113 (see FIG. 6). Therefore, the high-temperature air in the area above the fixing unit 82 is sucked through the air inlets 107 and is exhausted to the outside of the second processing section 10B through the first duct 101 and the first exhaust fan 113.

In addition, in the third duct 105, the air outlet 105D is positioned near the air inlets 107 in the first duct 101. Since the pressure in the first duct 101 is low, the air is sucked through the air inlet 105C. Therefore, the air in a boundary area between the first processing section 10A and the second processing section 10B and the entrance section 93 is caused to flow through the third duct 105 from the air inlet 105C to the air outlet 105D, and is discharged from the air outlet 105D. Then, the air is sucked through the air inlets 107, flows through the first duct 101, and is exhausted to the outside of the second processing section 10B. Thus, the first processing section 10A is thermally insulated from the fixing unit 82.

The high-temperature air in the area around the fixing unit 82 is exhausted to the outside of the second processing section 10B in the above-described manner. Therefore, the amount of heat dissipated from the fixing unit 82 to the first processing section 10A or to other components in the second processing section 10B can be reduced compared to the case in which the exhausting operation is not performed. Referring to FIG. 10, the sum of the amount of air Q1 exhausted by the first exhaust fan 113 and the amount of air Q2 exhausted by the second exhaust fan 115 is larger than the amount of air Q3 exhausted by the third exhaust fan 121. Therefore, in the second processing section 10B, the pressure in a section where the first exhaust fan 113 and the second exhaust fan 115 are provided is lower than the pressure in a section where the third exhaust fan 121 is provided. Accordingly, the high-temperature air in the area around the fixing unit 82 (see FIG. 8) can be prevented from flowing toward the third exhaust fan 121.

In addition, as illustrated in FIG. 7, the opening area S1 of the air inlets 107A positioned at the upstream side in the exhausting direction of the air in the first duct 101 is equal to or substantially equal to the opening area S2 of the air inlets 107B. Therefore, compared to the case in which S1>S2 is satisfied, that is, compared to the case in which the opening area at the side opposite to the exhaust side is relatively large, unevenness in the distribution of the amount of air suction along the exhausting direction can be reduced. As a result, unevenness in the temperature of the air in the first duct 101 along the exhausting direction can be reduced.

Figure 9:
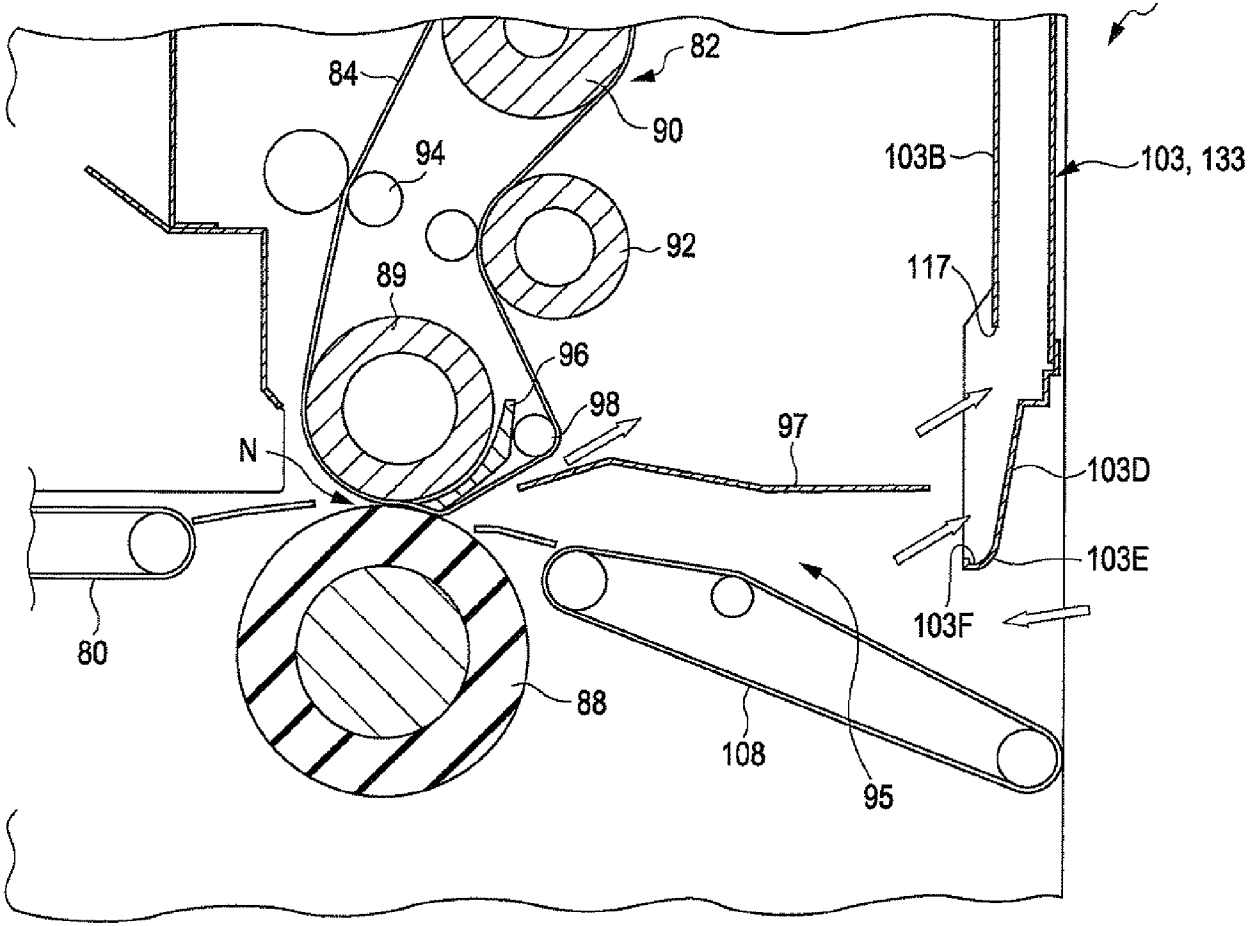
FIG. 9 is a partial view illustrating a suction housing included in the exhaust apparatus according to the exemplary embodiment of the present invention.

As shown in FIGS. 8 and 9, the pressure in the second duct 103 is lower (closer to vacuum) than the pressure in the area around the fixing unit 82, owing to the exhausting operation performed by the second exhaust fan 115 (see FIG. 6). Therefore, the high-temperature air in the ejection section 95 of the fixing unit 82 is sucked through the air inlet 117 and is exhausted to the outside of the second processing section 10B through the second duct 103 and the second exhaust fan 113. Since the sheet member P is heated in the nip section N in the high-temperature state in the fixing operation, moisture included in the sheet member P evaporates. However, high-temperature air containing water vapor is sucked through the air inlet 117, so that the water vapor does not remain in the ejection section 95. Accordingly, condensation of the water vapor in the ejection section 95 can be suppressed.

In addition, the guiding member 103D in the exhausting potion 103B of the second duct 103 is inclined toward the ejection section 95. Therefore, the direction in which the air is sucked crosses the transporting direction of the sheet member P. As a result, compared to the case in which the air inlet 117 is provided directly under the exhausting potion 103B in the vertical direction, the suction force applied to the sheet member P in the vertically upward direction can be reduced. Accordingly, the sheet member P transported from the nip section N of the fixing unit 82 is not easily raised.

In addition, in the second duct 103, the wall portion 103E, which changes the direction in which the air is sucked, has a curved shape. Therefore, compared to the case in which the wall portion 103E is bent at an angle close to 90 degrees, the flow path resistance can be reduced in the exhausting operation, and the influence placed on the transport of the sheet member P can also be reduced. In addition, since the stopping portion 103F is formed in the second duct 103, even when condensation of the water vapor occurs in the second duct 103, water droplets formed by condensation are received by the stopping portion 103F. As a result, the water droplets can be prevented from falling onto the sheet member P or a transporting surface along which the transporting device 108 is transported.

As described above, in the exhaust apparatus 100, the third duct 105 and the second duct 103 are disposed at the upstream side and the downstream side, respectively, in the transporting direction of the sheet member P and the first duct 101 is provided above the fixing belt module 86 so as to cover the fixing belt module 86, which is a heat source of the fixing unit 82. Therefore, the high-temperature air in the area around the fixing belt module 86 is exhausted to the outside of the housing (frame members 11 (see FIG. 1)) through the first duct 101, the second duct 103, and the third duct 105. Thus, dissipation of the heat is suppressed compared to the case in which the ducts are not provided so as to surround the fixing belt module 86.

The air in the fixing unit 82 that has been heated by the fixing belt module 86 tries to flow away from the fixing unit 82 through sections that are not covered by the first duct 101, the second duct 103, or the third duct 105. However, according to the present exemplary embodiment, the air inlet 105C and the air inlet 117 are provided at positions near the entrance side and the exit side through which the high-temperature air in the fixing unit 82 tries to flow away from the fixing unit 82. Accordingly, the high-temperature air that tries to flow away from the fixing unit 82 is sucked and exhausted to the outside of the housing. In addition, although the air heated by the fixing belt module 86 also flows upward, according to the present exemplary embodiment, the air inlets 107 are provided above the fixing belt module 86. Accordingly, the high-temperature air is sucked at positions toward which the air tries to flow. Therefore, compared to the case in which air inlets are provided at other positions, the air is more efficiently exhausted. As a result, according to the present exemplary embodiment, the heat in the fixing unit 82 is prevented from dissipating to the outside of the fixing unit 82.

Figure 11:
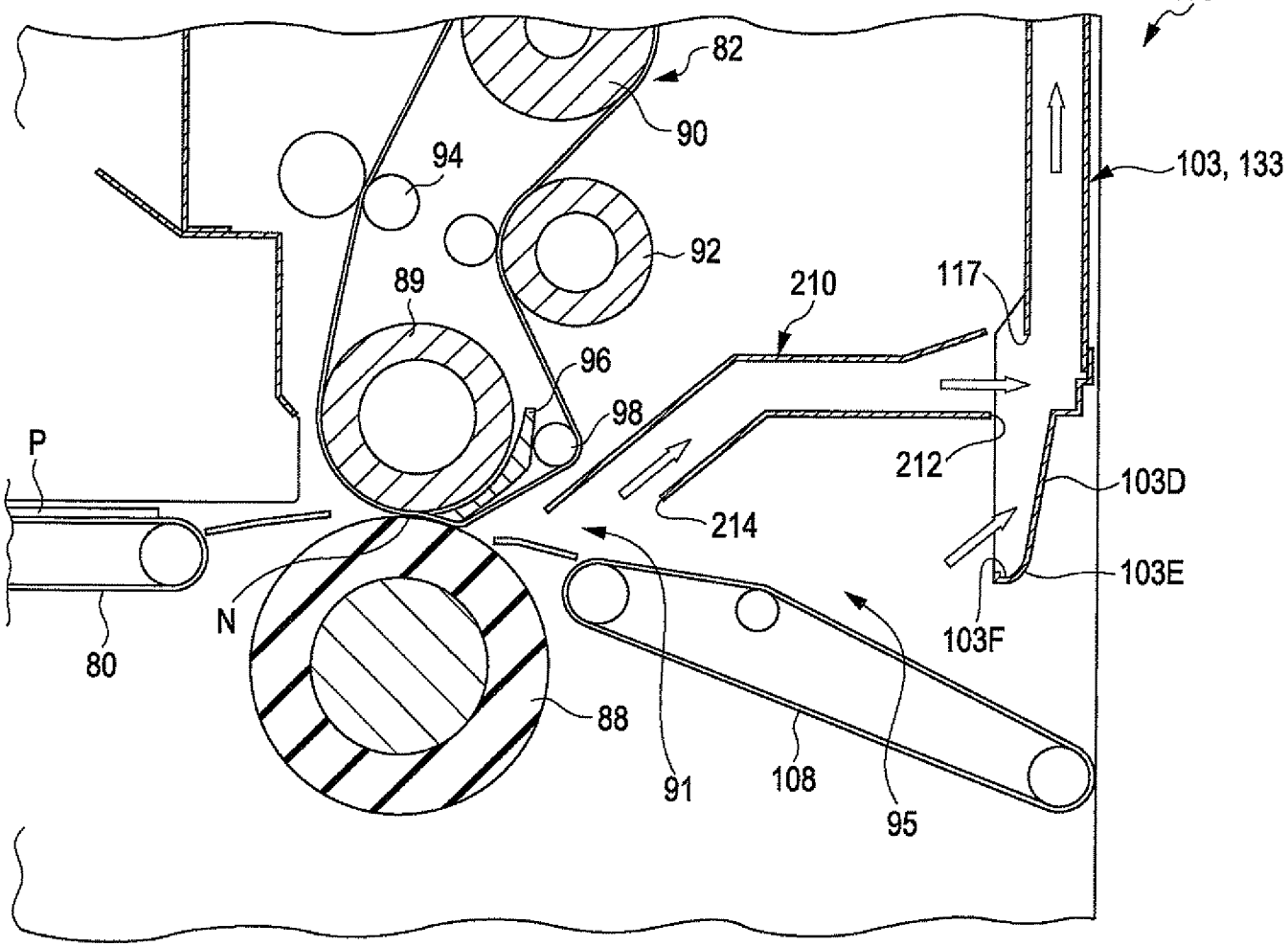
FIG. 11 is a diagram illustrating the structure of an exhaust apparatus according to another exemplary embodiment of the present invention.

FIG. 11 shows an exhaust apparatus 100 according to another exemplary embodiment. As illustrated in FIG. 11, a branching duct 210 may be provided by dividing an end portion of the second duct 103 at the air inlet side into an upstream portion and a downstream portion along the transporting direction of the sheet member P. The branching duct 210 is provided in place of the above-described top plate 97 (see FIG. 9), and is composed of a cylindrical body with an elbow-shaped cross section. The branching duct 210 has an air outlet 212 disposed at the ejection section 95 of the fixing unit 82 and an air inlet 214 disposed at an exit section 91 of the nip section N (see FIG. 8) from which the sheet member P is ejected (section around the exit side of the nip section N).

In the exhaust apparatus 100 including the branching duct 210, the air inlet 214 of the branching duct 210 is disposed at the exit section 91 and the air inlet 117 of the second duct 103 is disposed at the ejection section 95. The air is sucked through the air inlet 214 by the suction through the air inlet 117. Accordingly, although water vapor is generated by evaporation of moisture from the sheet member P immediately after the sheet member P is ejected from the nip section N in the fixing operation performed by the fixing unit 82, the generated water vapor is sucked through the air inlet 214 and discharged from the air outlet 212, and is then sucked through the air inlet 117 and exhausted to the outside of the second processing section 10B (see FIG. 1). In addition, the air containing water vapor that has been gradually generated by evaporation of moisture from the sheet member P during the transport of the sheet member P by the transporting device 108 is sucked through the air inlet 117 and is exhausted to the outside of the second processing section 10B (see FIG. 1). Thus, the air is sucked at different positions in the transporting direction of the sheet member P. Therefore, the air containing the water vapor can be prevented from remaining in the exit section 91 or the ejection section 95 through which the sheet member P is transported, and condensation of the water vapor can be suppressed.

The present invention is not limited to the above-described exemplary embodiments.

It is not necessary that the first duct 101 and the second duet 103 be disposed next to each other, and the first duct 101 may have an angular-U shape in cross section so as to cover the upper section of the fixing unit 82. In addition, the third duct 105 may be connected to and integrated with an end portion of the first duct 101. Alternatively, the third duct 105 may be omitted. In addition, the structure may also be such that the branching duct 210 is connected to the second duct 103 and the air is sucked only through the air inlet 214.

The temperature-humidity sensor 119 may be disposed in the first processing section 10A instead of the second processing section 10B. In addition, the temperature and humidity outside the image forming apparatus 10 may be measured in addition to the temperature and humidity in the image forming apparatus 10, and the amount of air exhausted by the first exhaust fan 113 and the second exhaust fan 115 may be changed in accordance with the result of the measurement. The fixing unit 82 is not limited to those including both the heating unit and the pressing unit, and the fixing unit 82 may also be such that only the heating unit is included.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exhaust apparatus comprising:

a first exhausting section including a first flow path and a first exhausting member, the first flow path being provided with an air inlet disposed above a heating device for heating a recording medium, the first flow path being configured to cause air in a housing that accommodates the heating device to flow to the outside, the first exhausting member exhausting the air using the first flow path;

a second exhausting section including a second flow path and a second exhausting member, the second flow path being provided with an air inlet disposed downstream of the heating device in a transporting direction in which the recording medium is transported, the second flow path being configured to cause the air in the housing to flow to the outside, the second exhausting member exhausting the air using the second flow path; and a third flow path being provided with an air inlet disposed upstream of the heating device in the transporting direction of the recording medium, the third flow path being configured to cause the air to flow from the air inlet of the third flow path to the air inlet of the first flow path, wherein the air inlet of the second flow path sucks the air along a direction inclined with respect to the transporting direction of the recording medium, a curved guiding member is provided at the air inlet of the second flow path, the guiding member allowing the air to be sucked from an upstream position in the transporting direction of the recording medium and guiding the sucked air upward, and the guiding member includes a stopping portion that stops water droplets from flowing toward an opening.

2. The exhaust apparatus according to claim 1, wherein an end portion of the second flow path at an inlet side is divided along the transporting direction of the recording medium such that the air is sucked at two positions that are an upstream position and a downstream position in the transporting direction.

3. The exhaust apparatus according to claim 1, wherein the first exhausting section exhausts the air at an end of the housing in a direction that crosses the transporting direction of the recording medium, and the first flow path is provided with a plurality of the air inlets arranged next to each other in the direction that crosses the transporting direction of the recording medium, the air inlets having substantially the same opening area.

4. An exhaust apparatus comprising:

a first exhausting section including a first flow path and a first exhausting member, the first flow path being provided with an air inlet disposed above a heating device for heating a recording medium, the first flow path being configured to cause air in a housing that accommodates the heating device to flow to the outside, the first exhausting member exhausting the air using the first flow path;

a second exhausting section including a second flow path and a second exhausting member, the second flow path being provided with an air inlet disposed downstream of the heating device in a transporting direction in which the recording medium is transported, the second flow path being configured to cause the air in the housing to flow to the outside, the second exhausting member exhausting the air using the second flow path; and a third flow path being provided with an air inlet disposed upstream of the being configured to cause the air to flow from the air inlet of the third flow path to the air inlet of the first flow path, wherein the first flow path and the second flow path are provided independently of each other, the first exhausting member is capable of varying an amount of air exhausted through the first flow path, and the second exhausting member is capable of varying an amount of air exhausted through the second flow path.

5. The exhaust apparatus according to claim 4, further comprising:

a temperature-humidity measuring unit provided at the housing and configured to measure a temperature and a humidity of the air inside or outside the housing; and a driving unit that drives the first exhausting member and the second exhausting member independently of each other on the basis at least one of the temperature and the humidity obtained by the temperature-humidity measuring unit.

6. An image forming apparatus comprising:

an image forming unit that forms an image on a recording medium with a developing agent;

a heating device provided downstream of the image forming unit in a transporting direction in which the recording medium is transported, the heating device heating the developing agent on the recording medium with a heating unit; and an exhaust apparatus comprising:

a first exhausting section including a first flow path and a first exhausting member, the first flow path being provided with an air inlet disposed above a heating device for heating a recording medium, the first flow path being configured to cause air in a housing that accommodates the heating device to flow to the outside, the first exhausting member exhausting the air using the first flow path;

a second exhausting section including a second flow path and a second exhausting member, the second flow path being provided with an air inlet disposed downstream of the heating device in a transporting direction in which the recording medium is transported, the second flow path being configured to cause the air in the housing to flow to the outside, the second exhausting member exhausting the air using the second flow path; and a third flow path being provided with an air inlet disposed upstream of the heating device in the transporting direction of the recording medium, the third flow path being configured to cause the air to flow from the air inlet of the third flow path to the air inlet of the first flow path, wherein a third exhausting member is provided at a position different from a position at which the heating unit is positioned in the housing, the third exhausting member exhausting the air to the outside of the housing, and the sum of an amount of air exhausted by the first exhausting member and an amount of air exhausted by the second exhausting member is larger than an amount of air exhausted by the third exhausting member.

7. The exhaust apparatus according to claim 1, wherein the first flow path and the second flow path are provided independently of each other, so as to not mix the air in both of the flow paths from the air inlets to the outside.

8. An image forming apparatus comprising:

an image forming unit that forms an image on a recording medium with a developing agent;

a heating device provided downstream of the image forming unit in a transporting direction in which the recording medium is transported, the heating device heating the developing agent on the recording medium with a heating unit; and the next apparatus according to claim 7.

* * * * *